US008991662B2

(12) United States Patent
Milan

(10) Patent No.: US 8,991,662 B2
(45) Date of Patent: Mar. 31, 2015

(54) ADAPTOR AND TIPS FOR CAULKING TUBES

(71) Applicant: Michael Milan, Raleigh, NC (US)

(72) Inventor: Michael Milan, Raleigh, NC (US)

( * ) Notice: Subject to any disclaimer, the term of this patent is extended or adjusted under 35 U.S.C. 154(b) by 62 days.

(21) Appl. No.: 13/767,976

(22) Filed: Feb. 15, 2013

(65) Prior Publication Data

US 2013/0214013 A1 Aug. 22, 2013

Related U.S. Application Data

(60) Provisional application No. 61/599,471, filed on Feb. 16, 2012.

(51) Int. Cl.
*B67D 3/00* (2006.01)
*B05B 1/16* (2006.01)
*B05C 17/005* (2006.01)

(52) U.S. Cl.
CPC ..... *B05B 1/16* (2013.01); *B05C 17/00506* (2013.01); *B05C 17/00509* (2013.01)
USPC ..... 222/538; 222/327; 222/567; 222/568

(58) Field of Classification Search
CPC ..... B65D 25/40; B65D 25/42; B65D 25/48; B65D 47/06; B05B 1/16; B05C 17/00506; B05C 17/00513; B05C 17/00516
USPC ..... 222/566–568, 325–327, 391
See application file for complete search history.

(56) References Cited

U.S. PATENT DOCUMENTS 3,016,173 A * 1/1962 Stull ..... 222/541.2
3,058,632 A * 10/1962 Stremmel ..... 222/567
3,191,809 A * 6/1965 Schultz et al. ..... 222/182
3,439,839 A 4/1969 Schumann et al.
4,258,884 A * 3/1981 Rogers ..... 239/390
4,284,213 A * 8/1981 Lee ..... 222/541.2
4,957,225 A 9/1990 Childers
5,104,013 A * 4/1992 Hawley ..... 222/566
5,346,380 A 9/1994 Ables
5,743,668 A 4/1998 Zimmerman
5,833,099 A 11/1998 Boaz et al.
5,865,555 A 2/1999 Dawson
5,871,106 A * 2/1999 Oksa et al. ..... 211/70.6
5,894,956 A 4/1999 Keith
6,375,051 B1 4/2002 Iverson
6,637,627 B1 * 10/2003 Liljeqvist et al. ..... 222/402.15
6,824,026 B1 * 11/2004 Boutwell ..... 222/562
6,910,608 B2 * 6/2005 Greer et al. ..... 222/538
6,981,611 B2 1/2006 Carruth et al.
7,014,079 B2 3/2006 Swann
7,232,047 B2 * 6/2007 Greer et al. ..... 222/538
7,712,635 B2 * 5/2010 Kovac ..... 222/327

(Continued)

FOREIGN PATENT DOCUMENTS

GB 2392120 A 2/2004
JP 09-24981 A 1/1997

*Primary Examiner* — Frederick C Nicolas
(74) *Attorney, Agent, or Firm* — Additon, Higgins & Pendleton, P.A.

(57) ABSTRACT

A dispensing adaptor is disclosed for tubes of high viscosity compositions. The adaptor includes an adaptor body, the interior of which defines a tube tip receiving opening having a size and shape corresponding to the tip of a tube of high viscosity composition, an adapter tip on the adaptor body through which the tip receiving opening continues, a custom tip for the adapter tip that fits on the adapter tip, and at least two sets of custom tip attachments on the adapter body.

20 Claims, 3 Drawing Sheets

(56) References Cited

U.S. PATENT DOCUMENTS

| | | | | |
|---|---|---|---|---|
| 8,360,285 | B2 * | 1/2013 | Grbesic | 222/207 |
| 8,397,959 | B2 * | 3/2013 | Helmenstein | 222/538 |
| 2004/0226968 | A1 * | 11/2004 | Lafond | 222/327 |
| 2005/0230439 | A1 | 10/2005 | McKee | |
| 2007/0102484 | A1 | 5/2007 | Baldwin | |
| 2007/0138216 | A1 * | 6/2007 | DeLaossa | 222/567 |
| 2009/0120970 | A1 | 5/2009 | Eighmie | |
| 2013/0214013 | A1 | 8/2013 | Milan | |

* cited by examiner

ADAPTOR AND TIPS FOR CAULKING TUBES

BACKGROUND

The invention relates to tubes such as those used in conventional caulking guns. In particular, the invention relates to the applicator tips from which caulking (or another composition of similar viscosity) is dispensed from a caulk tube.

Conventional caulking tubes typically include a cone-shaped end portion that the user cuts to open the tube to release the caulk.

As an associated problem, once the applicator tip (which is typically made of a polymer) is cut, the size of the opening can no longer be reduced, but only increased by cutting the tip at a larger-diameter portion closer to the tube. Additionally, caulking tips are often cut at a slight angle because an angled tip provides for smoother release of the caulk and better adherence to the surface being caulked. Thus, if a user cuts the cone at an improper or less helpful angle, the only manner of correcting the angle is to cut the tip again and form a larger opening. In turn, if the user wants a smaller opening, or a different angle for the opening, the only realistic option is to start with a fresh tube of caulk.

SUMMARY

In one embodiment, the invention is an adaptor for conventional caulk tubes. In this embodiment, the invention is a snap on, cone-shaped threaded adaptor that fits over the applicator end of a conventional caulk tube. The several tips of different sizes are attached to the cone section of the snap on adapter.

In another embodiment the adaptor can include a replaceable closed-end tip, for resealing a partially-used tube of caulk for later reuse.

In another embodiment the invention is the combination of a tube of a highly viscous composition with a tube tip for dispensing a composition from said tube and a dispensing adapter mounted on the tube tip.

The foregoing and other objects and advantages of the invention and the manner in which the same are accomplished will become clearer based on the followed detailed description taken in conjunction with the accompanying drawings.

DETAILED DESCRIPTION

Figure 1:
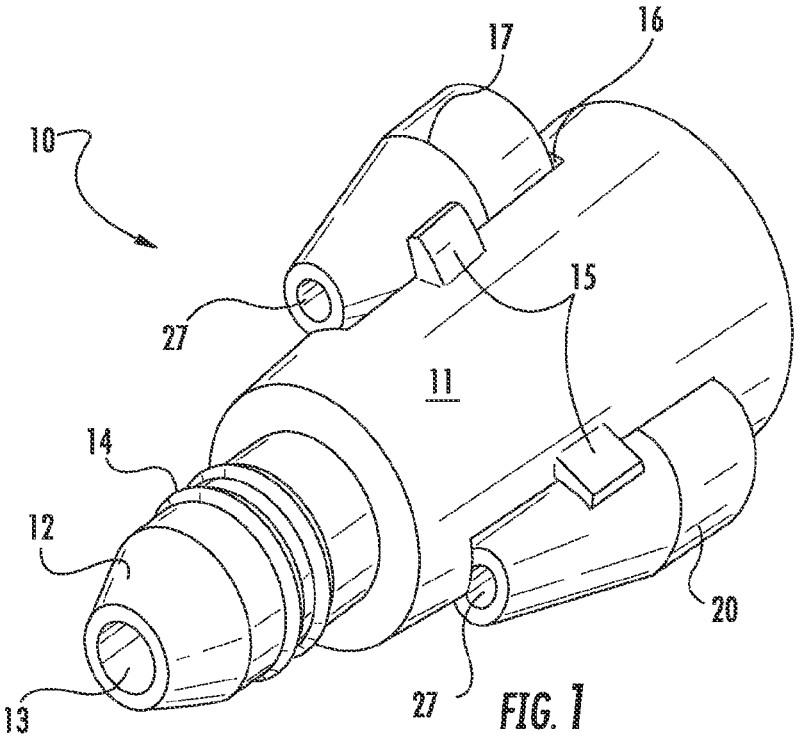
FIG. 1 is a perspective view of an embodiment of an adapter and tips according to the present invention.

In one embodiment, the invention is a caulk tube adapter that replaces—and in the illustrated embodiment overlies—the conventional dispenser tip of a caulking tube.

Caulk is a widely-available, common, well-understood, and highly viscous composition that is commercially sold in tubes and is appropriate for describing the features of the invention. The skilled person will understand, however, that the invention is not limited to caulk per se, but is useful for dispensing a variety of substances that have compositions and viscosities that make them convenient to be stored in and dispensed from tubes that are analogous to caulk tubes.

Additionally, because caulk is highly viscous, a caulk tube is often used as a cartridge in a caulking gun. Caulking guns are likewise well understood in the art and are common enough that no need exists to illustrate one separately. In general, a caulk gun is used to apply mechanical force to a caulk tube (usually in a piston-like manner) to in turn urge the caulk out of the relevant opening; i.e., the caulk tube tip 31 in the drawings.

The invention is, however, not limited to rigid cartridges or caulking guns, but instead can be used in conjunction with any type of commercial packaging that includes the caulk tube tip 31 or its equivalent.

FIG. 1 illustrates one embodiment of the adapter broadly designated at 10. The adapter 10 includes an adapter body 11 and an adapter tip 12, which is illustrated as threaded in FIG. 1. The adapter tip 12 includes an adapter tip dispensing opening 13. The adapter tip 12 includes a set of male threads 14 that will be best understood with respect to FIG. 4. The adapter body 11 includes at least one set, and preferably several sets, of attachments illustrated as the clips 15. The attachments (C-clips are exemplary) are positioned adjacent an indented saddle (or slot) 16 (FIGS. 3 and 4) into which the respective custom tips 17 and 20 can nest and be engaged by the C-clips 15. The C-clips are exemplary rather than limiting and other fasteners can be selected by those of skill in this art and without undue experimentation. Basically, the C-clips or their equivalents are sufficiently flexible to permit the custom tips to be attached or removed on a repeated basis without damaging either the clips of the custom tips.

In exemplary embodiments, the adapter and its various subparts can be formed of any material that is structurally sufficiently strong and that generally does not react unfavorably with caulk. Because of their well-understood properties, wide availability, ease of manufacture into shaped items, and relatively low-cost, polymers are generally appropriate for the adapter of the invention. Typical polymers for the adapter can include (but are not limited to) polyethylene, polypropylene, polyesters, polyurethanes, and polycarbonates. Depending upon the expected use environment, the polymer can be selected on the basis of cost, strength, resistance to chemical attack, or some other factor.

It will also be understood that although polymers are convenient materials for the adapter, the adapter material is not limited to polymers. Thus, when other materials would be superior or necessary for a particular application, no functional reason precludes the use of materials such as ceramics, metals, or composites.

Figure 2:
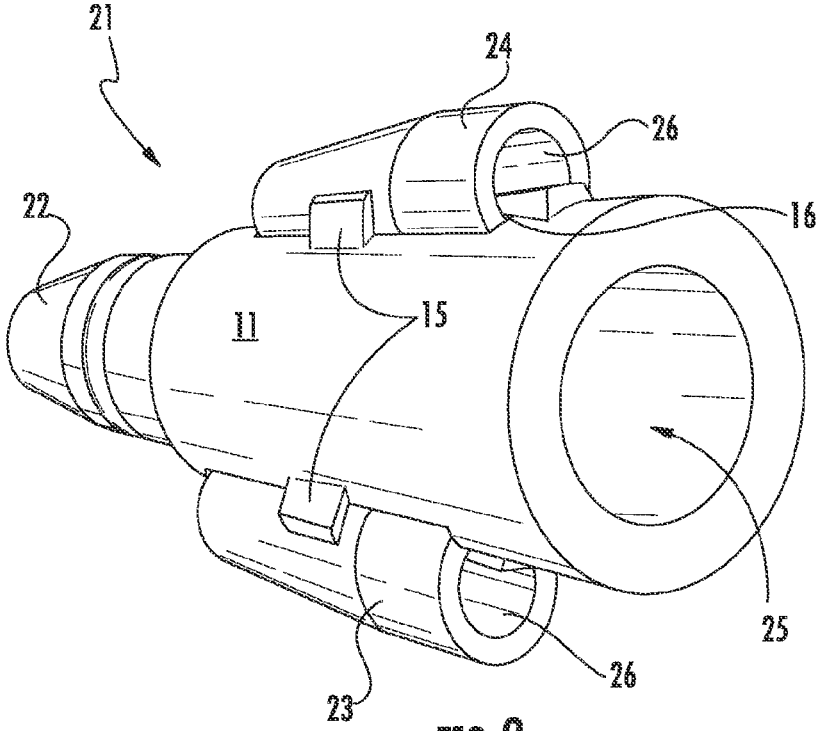
FIG. 2 is a perspective view of a second embodiment of an adapter and tips according to the present invention.

FIG. 2 illustrates a second embodiment for which many of the features are either identical or similar to the first embodiment. The adapter is broadly designated at 21 and includes an adapter body 11 which is generally the same as the adapter body 11 illustrated in FIG. 1. FIG. 2, however, illustrates a snap type adapter tip 22 as will be described in more detail with respect to FIG. 3. The adapter body 11 also includes the C-clips 15 and the indented saddles 16 for carrying the custom tips 23 and 24.

Although FIGS. 1 and 2 illustrate that the respective adapters 10, 21 carry two of the custom tips 17, 20, 23, 24 it will be understood that this is exemplary rather than limiting. Thus, and depending upon the size of the adapter and tips, a larger number of custom tips can be mounted on the adapter body 11.

The orientation of FIG. 2 also illustrates that in both embodiments the adapter body 11 forms a tube tip receiving opening 25 which has a size and shape that will snugly receive a caulk tube tip 31 in a manner that will be described in more detail in FIG. 3. The tube tip receiving opening 25 extends entirely through the adapter body 11 (e.g., FIGS. 3 and 4) to form the adapter tip dispensing opening 13. In some embodiments (not shown), the tip receiving opening can form an additional structure within, or in some cases extending from, the adapter body 11.

It will be understood that the adapter is not limited to a single size tube tip receiving opening 25, but that the adapter body 11 and the tube tip receiving opening 25 can be formed in different sizes to fit different caulk tube tips.

In a similar manner, the rear portions of the custom tips 17, 20, 23, 24 also include respective adapter receiving openings 26 for receiving the adapter tip 22.

In both embodiments (FIG. 1 and FIG. 2), the forward portions of each custom tip 17, 20, 23, 24 includes a custom tip dispensing opening 27. In particular, the adapter receiving opening 26 extends entirely through the custom tip to form the custom tip dispensing opening 27.

Figure 3:
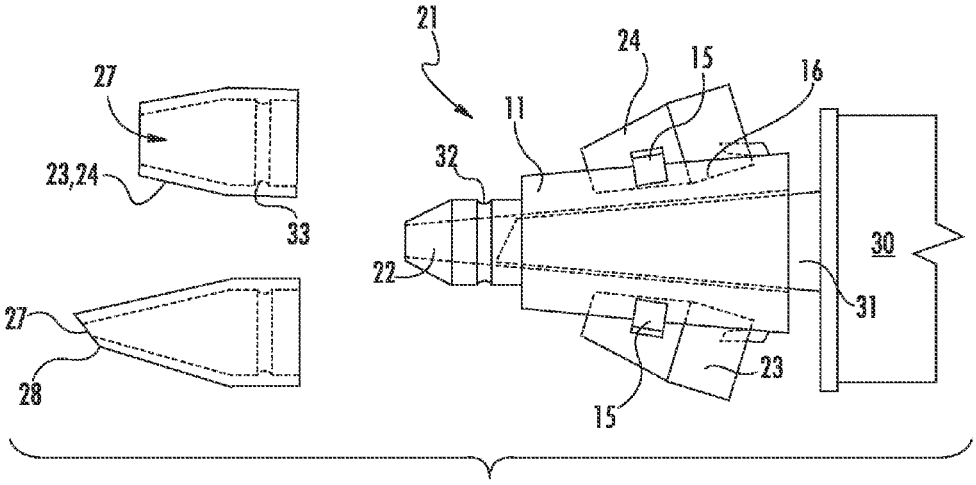
FIG. 3 is a side elevational view of the embodiment illustrated in FIG. 2.

FIG. 3 is a side elevational view of the adapter 21 illustrated in FIG. 2. FIG. 3 illustrates the adapter 21 in its environmental context; i.e., attached to the caulk tube 30 and specifically on the caulk tube tip 31. FIG. 3 illustrates that the snap type adapter tip 22 includes an annular groove 32 and that each snap fit custom tip 23, 24 includes an annular hook 33. The snap fit custom tip 23, 24 is sufficiently flexible for the hook 33 to expand over the larger portions of the adapter tip 22 and then snap into the annular groove 32 to secure the custom tip 23, 24 on the adapter tip 22.

Snap fittings are generally well understood in the art and will not be otherwise discussed in detail. A variety of snap type fittings can be employed, however, and thus the illustrated version is exemplary rather than limiting of these choices. In a snap fitting, the shape of the groove 32, the shape of the hook 33 and other factors can be adjusted to require greater or lesser force to add or remove the custom tip 23, 24 from the adapter tip 22 as may be desired or necessary.

In the embodiment illustrated in FIG. 3, the adapter 10, 21 fits on the caulk tube tip 31 with a friction fit. In other embodiments (not shown), the adapter 10, 21 and the caulk tube tip 31 can snap together using appropriate fittings. In yet other embodiments (not shown) the adapter 10, 21 can be held in place by the caulk gun rather than as a friction or snap fit onto the caulk tube tip 31. In these embodiments, either the adapter 21 or the adapter opening 25 can terminate in a washer-like structure that drops into (and behind) the U-shaped tip opening of a typical caulk gun. When the caulk gun applies pressure against the caulk tube, the tube holds the washer (and thus the adapter) firmly in place.

FIG. 3 also illustrates a different shape custom tip 28 in which the face of the custom tip dispensing opening 27 is illustrated as oblique (rather than parallel) to the face of the adapter tip dispensing opening 13, and in which the custom tip dispensing opening is somewhat smaller than the other illustrated embodiments.

Figure 4:
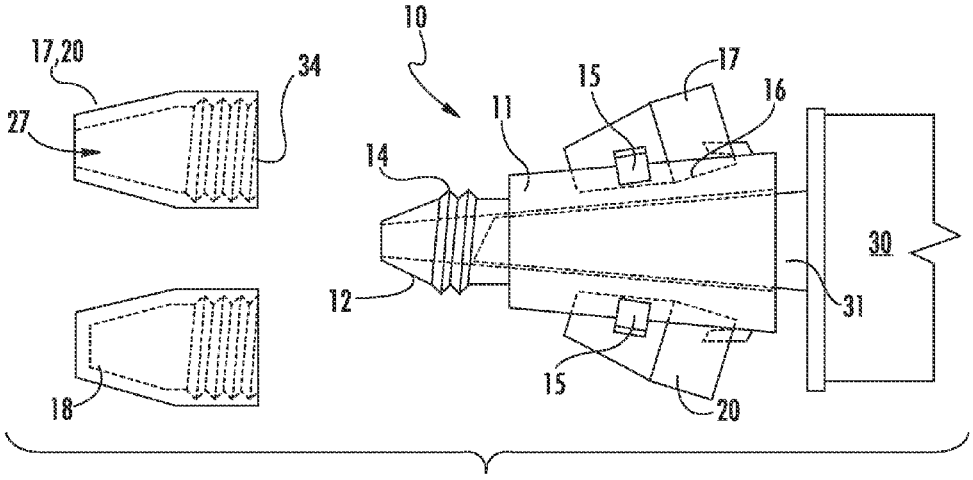
FIG. 4 is a side elevational view of the embodiment illustrated in FIG. 1.
Figure 5:
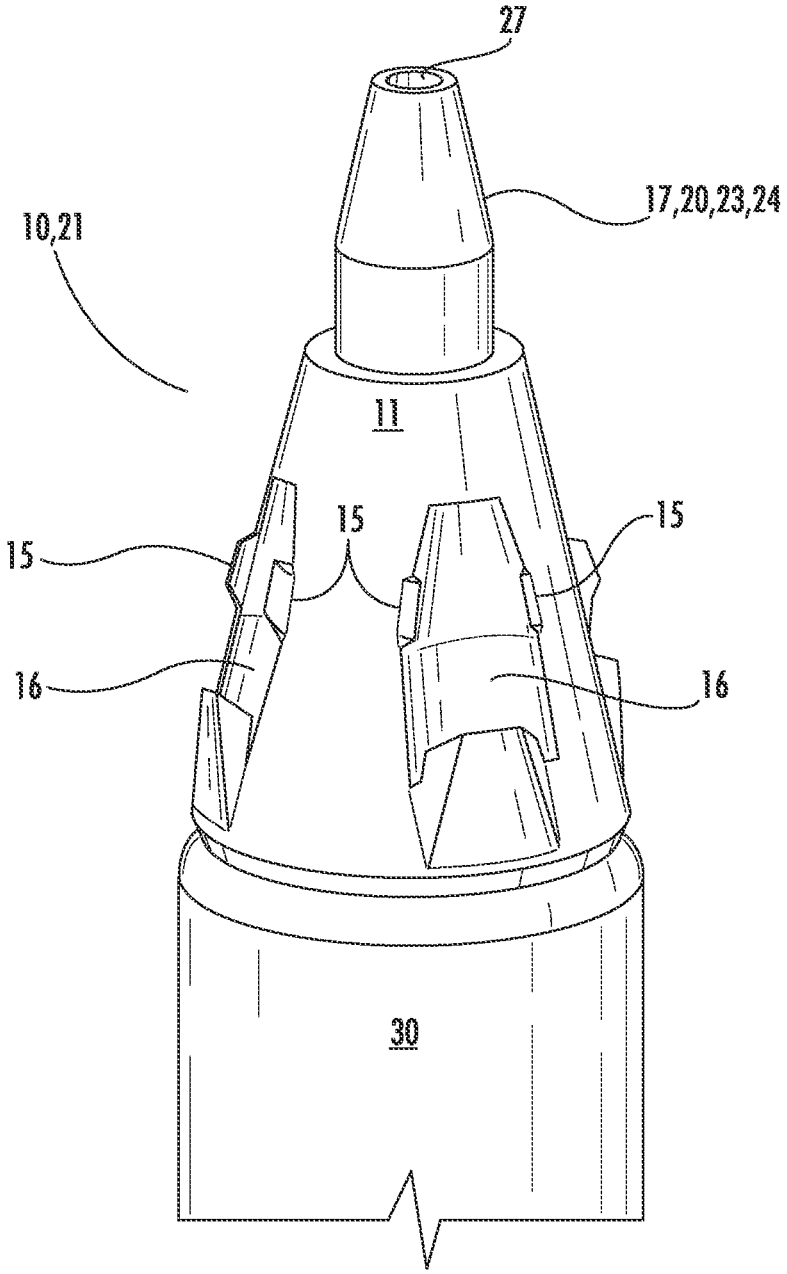
FIG. 5 is a perspective view of the embodiments illustrated in FIGS. 1 and 2.

FIG. 4 is a side elevational view of the adapter 10 illustrated in FIG. 1. The elements of the adapter 10 of this embodiment are the same in most respects as the adapter 21 illustrated in FIG. 3, with the exception that the threaded adapter tip 12 includes the male threads 14 and the custom tips 17, 20 include female threads 34 that correspond to the male threads 14.

FIG. 4 also illustrates a closed end custom tip 18 which can be positioned on the adapter 10 to close the caulk tube of 30 (and seal). It will be understood, of course, that the close tip can be combined with a snap on custom tip or that angled tip 28 can be threaded for use with the threaded adapter 10.

It will be further understood that for clarity purposes the illustrated custom tip dispensing openings 27 are not necessarily drawn to scale. In practice, the invention provides the advantages of custom tip dispensing openings 27 that are relatively small to thereby provide the user with an option to produce a smaller bead of caulk from the somewhat larger caulk tube tip 31.

The user can position the adapter 10, 21 on a caulk tube tip 31. In exemplary embodiments the shape of the tube tip receiving opening 25 corresponds to the shape of the caulk tube tip 31. Because of this, the caulk tube tip 31 can be trimmed prior to or during use. Indeed, one of the advantages of the adapter is that a caulk tube 30 and caulk tube tip 31 can be used without the adapter of the invention until the adapter is needed. In other words, when the user, having already cut the caulk tube tip 31 to a desired opening size, wants to change—and specifically reduce—the opening size, the user can add the adapter 10, 21 to the caulk tube tip 31.

Additionally, with the adapter 10, 21 in position, the user can select and change the desired custom tip 17, 20, 23, 24 conveniently on an as-needed or desired basis. As a further advantage, the closed end tip 18 can be used to close the caulk tube 30 to keep the caulk from drying in the tube and thus keep the caulk available for further use.

The removable nature of the adapter 10, 21 and the convenient materials (e.g. polymers) from which it is formed make it easy to clean the adapter 10, 21 during or between uses.

In the drawings and specification there has been set forth a preferred embodiment of the invention, and although specific terms have been employed, they are used in a generic and descriptive sense only and not for purposes of limitation, the scope of the invention being defined in the claims.

The invention claimed is:

1. A dispensing adaptor for tubes of high viscosity compositions, said adaptor comprising:

an adaptor body, the interior of which defines a tube tip receiving opening having a size and shape corresponding to a tip of a tube of high viscosity composition;

an adapter tip on said adaptor body through which said tube tip receiving opening continues to form an adapter tip dispensing opening;

at least two custom tips, each said custom tip securable on said adapter tip;

at least two sets of custom tip attachments on said adapter body, wherein each said custom tip is removably attachable to a set of said custom tip attachments; and a saddle in said adapter body positioned adjacent each said set of custom tip attachments for receiving a portion of said custom tip in said saddle when said custom tip is held on said adapter body in said custom tip attachments.

2. The dispensing adapter according to claim 1 wherein said custom tip attachments are C-clips.

3. The dispensing adapter according to claim 1 wherein said adapter tip includes male threads and each said custom tip includes corresponding female threads.

4. The dispensing adapter according to claim 1 wherein said adapter tip and each said custom tip together form a snap closure.

5. The dispensing adapter according to claim 4 wherein said adapter tip includes an annular groove and each said custom tip includes an annular hook that corresponds to said annular groove.

6. The dispensing adapter according to claim 1 wherein each said custom tip includes an adapter receiving opening that extends entirely through said custom tip to form a custom tip dispensing opening.

7. The dispensing adapter according to claim 6 wherein each said custom tip includes a dispensing opening that is smaller than the opening on a caulk tube tip and smaller than said adapter tip dispensing opening.

8. The dispensing adapter according to claim 6 wherein said custom tip dispensing opening is parallel to said adapter tip dispensing opening.

9. The dispensing adapter according to claim 6 wherein said custom tip dispensing opening is oblique to said adapter tip dispensing opening.

10. The dispensing adapter according to claim 1 wherein at least one of said custom tips has a closed end.

11. The combination comprising a tube of a highly viscous composition with a tube tip on said tube for dispensing a composition from said tube; and an adapter mounted on said tube tip;

said adapter comprising an adaptor body, the interior of which defines a tube tip receiving opening having a size and shape corresponding to said tube tip of said tube of high viscosity composition;

an adapter tip on said adaptor body through which said tip receiving opening continues to form an adapter tip dispensing opening;

at least two custom tips, each said custom tip securable onto said adapter tip;

at least two sets of custom tip attachments on said adapter body, wherein each said custom tip is removably attachable to a set of said custom tip attachments; and a saddle in said adapter body positioned adjacent each said set of custom tip attachments, each saddle for receiving a portion of said custom tip in said saddle when said custom tip is held on said adapter body in said custom tip attachments.

12. The combination according to claim 11 wherein said adapter tip includes male threads and each said custom tip includes corresponding female threads.

13. The combination according to claim 11 wherein said adapter tip and each said custom tip together form a snap closure.

14. The combination n according to claim 11 wherein each said custom tip includes an adapter receiving opening that extends entirely through said custom tip to form a custom tip dispensing opening.

15. The combination according to claim 14 wherein each said custom tip dispensing opening is smaller than the opening on said tube tip and smaller than said adapter tip dispensing opening.

16. The combination according to claim 11 wherein at least one of said custom tips has a closed end.

17. A dispensing adaptor for tubes of high viscosity compositions, said adaptor comprising:

an adaptor body, the interior of which defines a tube tip receiving opening having a size and shape corresponding to a tip of a tube of high viscosity composition;

an adapter tip on said adaptor body through which said tube tip receiving opening continues to form an adapter tip dispensing opening;

at least two sets of custom tip attachments on said adapter body, wherein said custom tip attachments are C-clips; and at least two custom tips for said adapter tip with each said custom tip attached to said custom tip attachments.

18. The dispensing adaptor according to claim 17 wherein said adapter tip includes male threads and each said custom tip includes corresponding female threads.

19. The dispensing adaptor according to claim 17 wherein said adapter tip and each said custom tip together form a snap closure.

20. The dispensing adaptor according to claim 19 wherein said adapter tip includes an annular groove and each said custom tip includes an annular hook that corresponds to said annular groove.

* * * * *